US005914301A

United States Patent [19]

Hsu et al.

[11] Patent Number: 5,914,301

[45] Date of Patent: Jun. 22, 1999

[54] MULTIPURPOSE DETERGENT

[76] Inventors: Yu-Chao Hsu; Wan-Yee Pan, both of 2/F., No. 91, Alley 76, Lane 600, Wu-Hsing St., Taipei City, Taiwan

[21] Appl. No.: 08/955,990

[22] Filed: Oct. 22, 1997

[51] Int. Cl.[6] ..... C11D 3/386; C11D 3/22; C11D 3/26

[52] U.S. Cl. ..... 510/189; 510/219; 510/226; 510/238; 510/320; 510/392; 510/228; 510/305; 510/309; 510/374; 510/375; 510/473; 510/501

[58] Field of Search ..... 510/189, 219, 510/226, 238, 320, 392, 228, 305, 309, 374, 375, 473, 501

[56] References Cited

U.S. PATENT DOCUMENTS 5,292,448 3/1994 Klugkist ..... 252/174.17

5,312,561 5/1994 Hoshino et al. ..... 252/174.12

*Primary Examiner*—Kery Fries

*Attorney, Agent, or Firm*—Rosenberg, Klein & Bilker

[57] ABSTRACT

A multipurpose detergent composed of: soda ash 40%~30% by weight; sodium sulfate 18%~25% by weight; sodium lauryl sulfate 23%~10% by weight; coconut oil fatty diethanolamide 11%~3% by weight; sodium carbonate peroxide 23%~10% by weight; citric acid 12%~3% by weight; sodium metasilicate 10%~2.5% by weight; carboxy methyl cellulose 7%~2% by weight; sodium lauroyl lactylate 15%~7% by weight; sodium polycrylate 5%~1% by weight; and natural enzyme 8%~2% by weight.

2 Claims, 1 Drawing Sheet

MULTIPURPOSE DETERGENT

BACKGROUND OF THE INVENTION

The present invention relates to detergent, and more particularly to a multipurpose detergent which is non-toxic, decomposable, and not harmful to the environment.

Environmental pollution problem is severe everywhere around the world. Waste water from factories and homes are fatal to living things in rivers. Most rivers in the world have been heavily polluted by waste water from all sources. Regular detergent for home use commonly contains harmful substances such as benzene, fluorescent bleaching agent, phosphorus, etc. Benzene and fluorescent bleaching agent are cancerogenic substance. Benzene affects the central nervous system, the blood making system, and the immune system when it enters the body. The skin aches and itches when it is put into direct contact with benzene. Fluorescent bleaching agent cannot remove dirt from clothes. Direct contact with fluorescent bleaching agent may cause a red swelling of the skin, or a disease to the skin. Adding phosphorus to a detergent enables the detergent to change hard water into soft water, however waste water containing phosphorus helps plankton to propagate with extreme rapidity, thereby causing water living things to die due to lack of oxygen. When a big quantity of plankton gathers at a seaport or riverside, a "red tide" phenomenon occurs (because plankton show a dark red color when gathered together). Eating shells caught from "red tide" area may cause one poisoned. In order not to pollute the environment, it is not recommended to use toxic detergent, or any detergent which pollutes the rivers.

SUMMARY OF THE INVENTION

The present invention has been accomplished under the circumstances in view. It is one object of the present invention to provide a detergent which is non-toxic, decomposable, and not harmful to the environment. It is another object of the present invention to provide a detergent which can be used for washing clothes, floors, bathrooms, kitchen rooms, kitchen utensils, dishes and cups, windows, vehicles, etc.

DETAILED DESCRIPTION OF THE PREFERRED EMBODIMENT

Figure 1:
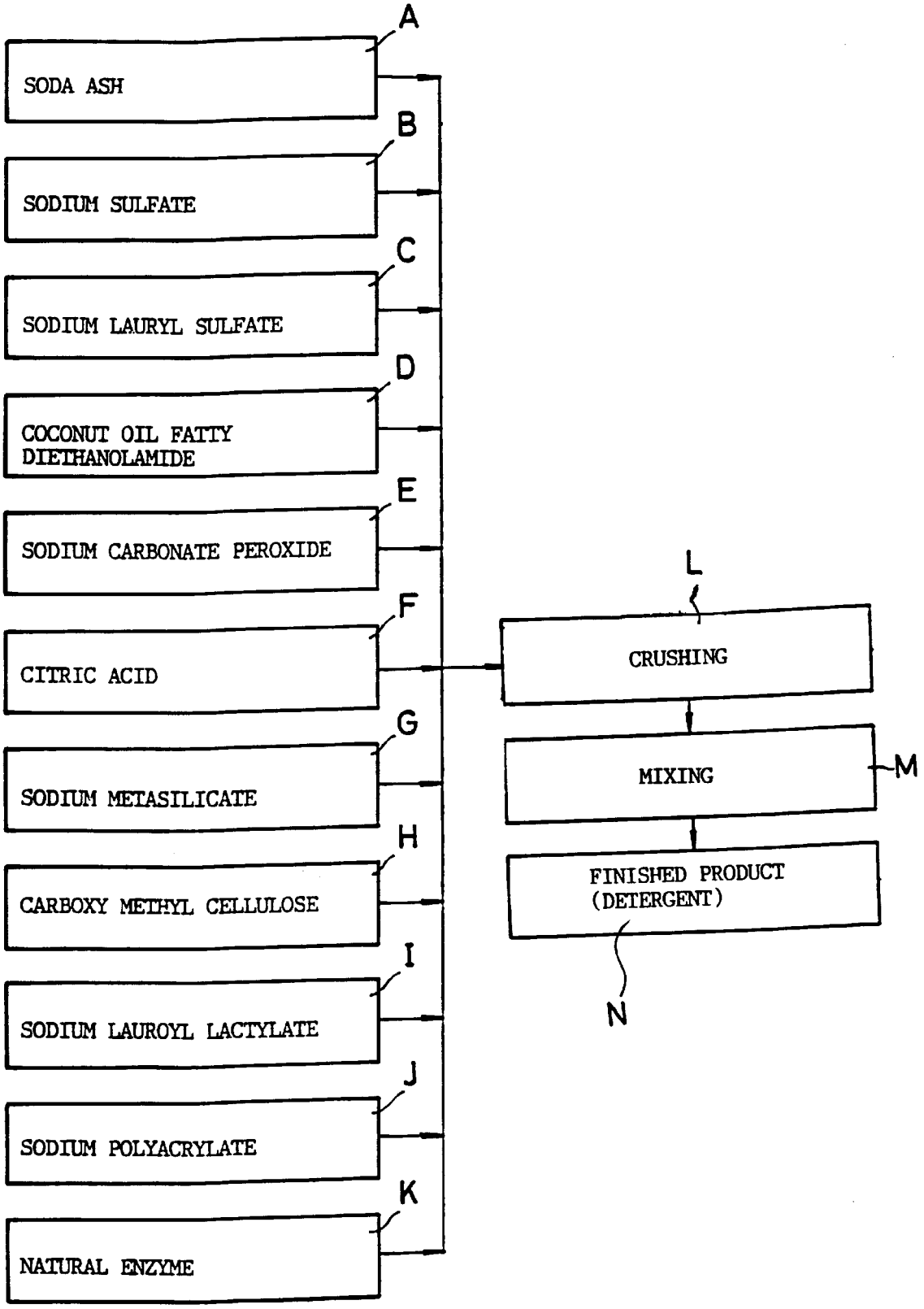
FIG. 1 is a block diagram showing the manufacturing flow of the present invention.

Referring to FIG. 1, a detergent N in accordance with the present invention is composed of soda ash A 40%~30% by weight, sodium sulfate B 18%~25% by weight, sodium lauryl sulfate C 23%~10% by weight, coconut oil fatty diethanolamide D 11%~3% by weight, sodium carbonate peroxide E 23%~10% by weight, citric acid or sodium citrate F 12%~3% by weight, sodium metasilicate G 10%~2.5% by weight, carboxy methyl cellulose H 7%~2% by weight, sodium lauroyl lactylate I 15%~7% by weight, sodium polyacrylate J 5%~1% by weight, and natural enzyme K 8%~2% by weight.

Soda ash A is used to change hard water into soft water, and to remove dirt from an object. Sodium sulfate is used as filling material. Sodium lauryl sulfate C is used to remove dirt. Coconut oil fatty diethanolamide D is used to neutralize other compositions, so as to eliminate free acid and to protect the skin. Sodium carbonate peroxide E is used to kill bacteria and to bleach washed items. Citric acid or sodium citrate F is used to remove dirt and to neutralize solution so as to protect the skin. Sodium metasilicate G is used as filling material, and it is also capable of removing dirt. Carboxy methyl cellulose H is used to prevent removed dirt from depositing on washed items. Sodium lauroyl lactylate I is a non-toxic non-irritant substance used as an emulsifying agent, foam stabilizer, and viscosity index improver. Sodium polyacrylate J is a high molecular condensing agent used to condense micro particles in water. Natural enzyme K is used to decompose dirt.

When all materials are prepared subject to the aforesaid compositions, the prepared materials are crushed into powder L, and then well mixed M into finished product N. A detergent made according to the present invention is non-toxic, decomposable, and not harmful to the environment. It can be used for washing clothes, floors, bathrooms, kitchen rooms, kitchen utensils, dishes and cups, windows, vehicles, etc.

What the invention claimed is:

1. A multipurpose detergent composed of:

soda ash 40%~30% by weight;

sodium sulfate 18%~25% by weight;

sodium lauryl sulfate 23%~10% by weight coconut oil fatty diethanolamide 11%~3% by weight;

sodium carbonate peroxide 23%~10% by weight;

citric acid 12%~3% by weight;

sodium metasilicate 10%~2.5% by weight;

carboxy methyl cellulose 7%~2% by weight;

sodium lauroyl lactylate 15%~7% by weight;

sodium polyacrylate 5%~1% by weight; and natural enzyme 8%~2% by weight.

2. A multipurpose detergent composed of:

soda ash 40%~30% by weight;

sodium sulfate 18%~25% by weight;

sodium lauryl sulfate 23%~10% by weight coconut oil fatty diethanolamide 11%~3% by weight;

sodium carbonate peroxide 23%~10% by weight;

sodium citrate 12%~3% by weight;

sodium metasilicate 10%~2.5% by weight;

carboxy methyl cellulose 7%~2% by weight;

sodium lauroyl lactylate 15%~7% by weight;

sodium polyacrylate 5%~1% by weight; and natural enzyme 8%~2% by weight.

* * * * *